US008616837B2

(12) United States Patent
Scholz et al.

(10) Patent No.: US 8,616,837 B2
(45) Date of Patent: Dec. 31, 2013

(54) VARIABLE GEOMETRY TURBOCHARGER LOWER VANE RING RETAINING SYSTEM

(75) Inventors: Georg Scholz, Woellstein (DE); Richard Hall, Nebo, NC (US); George E. Heddy, III, Hendersonville, NC (US)

(73) Assignee: Borgwarner, Auburn Hills, MI (US)

( * ) Notice: Subject to any disclaimer, the term of this patent is extended or adjusted under 35 U.S.C. 154(b) by 0 days.

(21) Appl. No.: 13/587,130

(22) Filed: Aug. 16, 2012

(65) Prior Publication Data

US 2012/0308376 A1 Dec. 6, 2012

Related U.S. Application Data

(63) Continuation of application No. 12/490,741, filed on Jun. 24, 2009, now Pat. No. 8,267,647.

(60) Provisional application No. 61/079,386, filed on Jul. 9, 2008.

(51) Int. Cl.
*F04D 29/46* (2006.01)

(52) U.S. Cl.
USPC ..... 415/164; 415/209.2

(58) Field of Classification Search
USPC ..... 415/164, 165, 191, 209.2, 209.3
See application file for complete search history.

(56) References Cited

U.S. PATENT DOCUMENTS

| | | | | | |
|---|---|---|---|---|---|
| 4,702,672 | A * | 10/1987 | Leicht et al. | ..... | 415/164 |
| 4,770,603 | A * | 9/1988 | Engels et al. | ..... | 415/147 |
| 4,836,747 | A * | 6/1989 | Hotz | ..... | 415/163 |
| 5,851,104 | A * | 12/1998 | Dakin et al. | ..... | 415/150 |
| 7,303,370 | B2 * | 12/2007 | Metz et al. | ..... | 415/150 |
| 8,061,976 | B2 * | 11/2011 | Hall | ..... | 415/160 |
| 8,418,460 | B2 * | 4/2013 | Ehrhard | ..... | 415/164 |
| 2006/0034684 | A1 * | 2/2006 | Metz et al. | ..... | 415/191 |

* cited by examiner

*Primary Examiner* — Edward Look
*Assistant Examiner* — Liam McDowell
(74) *Attorney, Agent, or Firm* — Miller Canfield

(57) ABSTRACT

A vane ring assembly which includes a lower vane ring (22), an upper vane ring (30), one or more guide vanes (80) positioned at least partially between the vane rings, and a plurality of spacers (42, or 50) positioned between the lower and upper vane rings for maintaining a distance between the lower and upper vane rings. By using a first set of fasteners (190) to fasten the lower vane ring to the turbine housing, and a second set of fasteners (191) to fasten the lower vane ring to the upper vane ring, the vane ring assembly is effectively decoupled from the turbine housing with regard to differential thermal expansion, and the co-planerism of the vane rings is easier to maintain.

13 Claims, 18 Drawing Sheets

VARIABLE GEOMETRY TURBOCHARGER LOWER VANE RING RETAINING SYSTEM

FIELD OF THE INVENTION

This invention is directed to a turbocharging system for an internal combustion engine and more particularly to a design of a VTG system, isolating the upper vane ring from the turbine housing, thus allowing reduced stress from differential thermal expansion.

BACKGROUND OF THE INVENTION

Turbochargers are a type of forced induction system. They deliver compressed air to the engine intake, allowing more fuel to be combusted, thus boosting the engine's horsepower without significantly increasing engine weight. This can allow for the use of a smaller turbocharged engine, replacing a normally aspirated engine of a larger physical size, thus reducing the mass and aerodynamic frontal area of the vehicle. Turbochargers use the exhaust flow from the engine to drive a turbine, which is mechanically connected to a compressor. At startup, the turbocharger may be at temperatures well below 0° C. Since the turbine spins at extremely high speed, in the range of 150,000 RPM to 300,000 RPM, is mechanically connected to the exhaust system, it sees high levels of temperature, up to 1050° C. for a gasoline engine, and vibration. Such conditions have a detrimental effect on the components of the turbocharger. Because of these adverse conditions the design, materials and tolerances must be selected to provide adequate life of the assembly. The design selections, required to satisfy these conditions, often lead to larger than preferred clearances, which, in turn, cause aerodynamic inefficiencies. Further, the flow of exhaust gasses impart rotational torque on the vane assembly, which must be prevented from rotation by mechanical securing means.

Turbochargers, which utilize some form of turbine flow and pressure control are called by several names and offer control though various means. Some have rotating vanes, some have sliding sections or rings. Some titles for these devices are: Variable turbine design (VTG), Variable geometry turbine (VGT) variable nozzle turbine (VNT), or simply variable geometry (VG). The subject of this patent is the rotating vane type of variable turbine, which will be referred to as VTG for the remainder of this discussion.

VTG turbochargers utilize adjustable guide vanes (FIG. 1 (80)), rotatably connected to a pair of vane rings (30, 20) and/or nozzle wall. These vanes are adjusted to control the exhaust gas back pressure and the turbocharger speed by modulating the exhaust gas flow to the turbine wheel. The vanes are rotatably driven by the fingers (FIG. 7, 61), which are located above (in the direction of assembly, i.e., to the left in FIG. 1) the upper vane ring (30). For the sake of clarity, these details have been omitted from most of the drawings. VTG turbochargers have a large number of components which must be assembled and positioned in the turbine housing so that the guide vanes remain properly positioned with respect to the exhaust supply flow channel, and the turbine wheel, over the range of thermal operating conditions to which they are exposed. Typical VTG turbochargers employ three fasteners (111, 112, 113) which are either studs, bolts, or studs with nuts, to secure the vane ring assembly (e.g., the vane ring and guide vanes) to the turbine housing (100) so that the turbine housing assembly surrounds the vane ring assembly. The fasteners pass through both vane rings to clamp the upper vane ring to the spacer, the spacer to the lower vane ring, and the lower vane ring to the turbine housing.

The connection of such an assembly to the turbine housing produces several important issues: As can be seen in FIG. 7, the parallelism of the vane ring assembly including vane rings (20) and (30) must be parallel to the turbine housing (100). The vanes (80) must be placed such that the vane cheek surfaces (81) are adjacent to and parallel to the upper and lower vanes rings. The turbine housing machined face (101) must be machined in the correct axial location for the vanes to line up with the turbine flow at the entry of the turbine wheel. The angular location of the vane ring assembly to the turbine housing datum (FIG. 9, 126) is determined by the radius from the centerline of the bore of the turbine housing and a set of coordinate dimensions (124). These dimensions determine the X-Y-Z location of the vane assembly to the turbine housing.

The effect of temperature on the turbine housing results in both thermal expansion (at the rate of the coefficient of thermal expansion for the iron or steel of the turbine housing or respective part being heated) influenced by the thermal flux caused by the flow path of the exhaust gas, which is additionally influenced by the geometry and wall thickness of the turbine housing. The inherent nature of a turbine housing under thermal influence is for the "snail section" to try to unwind from its ambient temperature shape and position. This often results in a twisting motion, dependant upon the constraints of the casting geometry. Unconstrained by attachment to the turbine foot, gussets or ribs, the turbine housing large apertures, which are cylindrical at room temperature, assume an oval shape at operating temperature.

This relatively simple thermal expansion, combined with the results of the geometric and thermal flux influences, results in complex deformation of the turbine housing across the temperature range.

When an assembly, such as the vane ring assembly, is mounted to the turbine housing wall as in FIG. 1 and FIG. 4, the studs or bolts (8, 13) will assume the motion of said wall, albeit in a manner somewhat perpendicular to said wall. When the turbine housing wall moves due to thermal influences, the mountings will mimic that movement. In FIG. 10, the fasteners (111), (112), (113) are each held in perpendicular position by the tapped holes (121), (122), (123) in the turbine housing (100).

The fasteners (111), (112), (113) are held in both X-Y and angular position by the placement of the tapped holes in the turbine housing. The relative position of each hole, to the center of the turbine housing (120), is determined by the coordinate X-Y positions of each tapped hole (121), (122), (123) to the coordinate position of the turbine housing center (120), and the angular position by the relationship of the set of the three holes to a datum (126), determined by the X and Y coordinates (124) (see FIG. 9).

FIG. 11 shows that a simple case of distortion in the turbine housing mounting face (101) has a large effect, offset, but basically perpendicular to the turbine housing mounting face as in FIG. 10. The base position of the fasteners (111, 112, 113), determined by the tapped holes (121, 122, 123) in the turbine housing, on pitch circle diameter (PCD) (125, FIG. 9), changes a small amount due to the change from flat to curved of the turbine housing mounting face (101). It can be seen however in FIG. 11 that the dimension "A" at top end of the fasteners (111), (112), 113) moves considerably more, than does the dimension "B" at the bottom end of the fastener. The angular position of the fasteners, relative to the datum (126) stays relatively constant. In a like manner the distortion of the turbine housing could be convex, instead of concave, which would result in the dimension, at the top end of the fasteners, moving in a direction which produces a top end dimension "A" being less than the bottom end dimension "B". The important thing is the deformation and motion, not the direction of deformation, and resultant motion. This is a simple case of distortion, which does not take into account the planar change in tapped hole position due to simple thermal coefficient of expansion. In this case, which overlays the above, the circular machined bores become an oval shape, which further exacerbates the situation.

This displacement of the fastener causes distortion in the vane rings, which then causes the vanes and moving components to jam. If the clearances between components are loosened in order to reduce sticking of the vanes, the added buffer clearances cause a loss of aerodynamic efficiency, which is unacceptable. The clearance between vane side faces (FIG. 12 (81)), and their partner vane ring inner faces is especially critical to aerodynamic efficiency. The displacement of the fasteners also generates high stress in the fastener, which results often in failure of the fastener. Unusual wear patterns, due to distortion in the vane ring, also generate unwanted clearances, which further reduce the aerodynamic efficiency.

Tapped holes are a reasonably efficient manufacturing method but are simply not effective when it comes to dimensional accuracy or repeatability. While it is normal practice to generate acceptable accuracy and repeatability with drilled or reamed holes, the threading activity is fraught with problems. The threaded region of both the fastener and the hole has to be concentric with the unthreaded zone of the shaft and hole in order to place the fastener in the appropriate X-Y position with respect to the hole. By the very nature of threads it is usual for the male feature to lose its perpendicularity to the female feature (and vice versa) as increased torque applied to the fastener rocks the un-torqued portion of the fastener towards the thread angle, which has the effect of tipping the fastener, in the case of a male stud or bolt in a female hole, away from perpendicular to the threaded surface plane.

In U.S. Pat. No. 6,558,117 to Fukaya, a VTG turbocharger is shown having a vane ring assembly integrally connected to the turbine housing via bolts. The Fukaya device is shown in FIGS. 2, 3 and 4, has a turbine casing (1), rotatable guide vanes (2), a flow passage spacer (3), a bill-like projection portion (4) and a turbine rotor (5). Each of the guide vanes (2) is supported by a rotational shaft (7) extending outward of a guide vane table (6). A bolt (8) extends through the guide vane table (6) and the flow passage spacer (3), and is fastened to the casing (1).

To account for thermal deformation of the casing (1) and the guide vane table (6), an outer diameter of the Fukaya flow passage spacer (3) must be set to about 9 mm. Fukaya also uses material selection to combat thermal expansion. A material having the same coefficient of linear expansion as that of the guide vanes (2) (for example, SCH22 (JIS standard)) is employed for a material of the flow passage spacer (3) and the bolt (8). A width $h_s$ of the flow passage spacer (3) is designed to be slightly larger than a width $h_n$ of the guide vanes (2), and an attempt is made to minimize the gap between both of the side walls of the casing (1) and the guide vane table (6) sectioning the turbine chamber, and the guide vanes (2).

Due to the integral connection of the housing (1) with the vane table (6), the Fukaya turbocharger suffers from the drawbacks of having to allow clearances to account for thermal growth. Such gaps reduce the performance of the turbocharger. The Fukaya turbocharger also requires the use of material with a low thermal coefficients of expansion. Such materials can be costly and difficult to work with.

Fukaya further proposes another variable geometry turbocharger as shown in FIGS. 3 and 4. Three bolts (13) each having an outer diameter of 5 mm are arranged at positions uniformly separated into three portions in a peripheral direction. The bolt (13) extends through a portion of the guide vane table (6) that extended to the casing (1) side and fastens the guide vane table (6) to the casing (1). A heat-resisting cast steel HK40 (ATSM standard) having a little amount of carbon is employed for a material of the casing (1), the guide vane table (6) and the guide vane (2). A distance between both of the side walls of the casing (1) and the guide vane table (6) is defined by $h_a - h_b$, and is designed to be slightly larger than the width $h_n$ of the guide vane (2).

While this other embodiment of Fukaya removes the fasteners from the flow path, it still provides an integral connection of the housing (1) with the vane table (6), which will result in the transfer of stresses and/or growth from the casing to the vane ring components. The Fukaya turbocharger also requires the use of material with low thermal coefficients of expansion. Such materials can be costly and difficult to work with.

In U.S. Pat. No. 6,679,057 to Arnold, a variable turbine and variable compressor geometry turbocharger is described as shown in FIG. 5. Each of the turbine vanes is connected to the turbine housing via a vane post. The vane post is inserted into a correspondingly sized hole in the turbine housing. The Arnold device also suffers from the drawback of radial thermal expansion of the turbine housing imparting undue stress and/or movable components "sticking" due to the use of the vane post connection in the housing.

In U.S. Pat. No. 7,021,057 B2 to Sumser, an exhaust-gas turbocharger with a VTG vane structure is described as shown in FIG. 6 in which spacer bushes (21) are provided to ensure that there is a defined minimum distance between the outer support wall (11) and the inner support wall (14). The variable turbine vane structure is fixed by means of bolts (22), which extend between the end section (17) of the support wall (14) and the support wall (11). Also here, the vane ring components will suffer thermal stresses imparted by the turbine housing due to the fixed structure.

U.S. Pat. No. 5,186,006 to Petty, references cross cut keys as a method for the mounting of a ceramic shell defining a turbine housing onto a metal engine block using a set of ceramic cross cut keys connected to a second set of cross cut keys on a metal spider bolted to the engine block.

U.S. Pat. No. 6,287,091 to Svihla et al, references radial keys and guides to be used in aligning the nozzle ring of an axial turbocharger for a railway locomotive.

FIG. 20 depicts the centering drive from a Cosworth DFV, or DFX racing engine. These engines were first produced in 1967 and have been in general production for some 40 years. This drive mechanism is used to provide drive to the oil and water pumps on the sides of the engine, irrespective of the thermal conditions of either pump. The temperature of the fluids in the pumps cause the pumps to expand or contract against the engine block, thus changing the centerlines of the pumps, relative to the driving flange which is also solidly mounted to the engine block, albeit under a different set of thermal conditions. So in most cases the center of the flanges is not concentric with its mating flange, but the design enables a vibration free drive to take place.

In this design the driving flange (182) is screwed onto a driving shaft (187) connected by belt drive to the engine crankshaft. The driving flange features a radial male key (186), which engages into a female radial slot (185) in the cross-key coupler (180). In this embodiment of the cross-key design, the coupler (180) has two diametral keys, one male (185) and one female (184) at an angle of 90° to each other. The driven flange (181) features a male key (183) machined into its face. The male key engages in the female slot (184) in the coupler (180). The coupler is held in axial position only by the proximity of the driving, and driven, flanges. The coupler is held in radial position by the action of the two mating keys and keyways in the opposing flanges. Thus the coupler provides a centerline drive from the driving flange (182) to the driven flange (181).

Thus, there is a need for a fastening system and method for connecting the vane ring assembly to the turbine housing. There is a further need for such a system and method that accounts for thermal growth and distortion of the turbine housing and/or vane ring assembly while maintaining peak efficiency. There is a yet a further need for such a system and method that is cost effective and dependable. There is additionally a need for such a system and method that facilitates manufacture, assembly and/or disassembly.

SUMMARY OF THE INVENTION

As illustrated in the exemplary embodiments, the vane ring assembly effectively decouples the assembly from the turbine housing and eliminates the potential for vanes to stick due to relative movement through thermal growth, as is experienced when the lower and upper vane support rings are rigidly affixed to the turbine housing via studs, bolts, and the like.

The exemplary embodiments provide a fastening system and method for connecting the vane ring assembly to the turbine housing that minimizes the effect of thermal growth, or the effects of differential thermal growth, of the housing and/or vane ring assembly while maintaining efficiencies. The exemplary embodiments are cost effective, dependable, and are designed for ease of assembly.

In accordance with the invention, by using a first set of fasteners to fasten the lower vane ring to the turbine housing, and a second set of fasteners to fasten the lower vane ring to the upper vane ring, the vane ring assembly is effectively decoupled from the turbine housing and the co-planerism of the vane rings is easier to maintain.

BRIEF DESCRIPTION OF THE DRAWINGS

The present invention is illustrated by way of example and not limitation in the accompanying drawings in which like reference numbers indicate similar parts, and in which.

DETAILED DESCRIPTION OF THE INVENTION

In the prior art the vanes rings are firmly attached to the turbine housing, which is subjected to a non-homogeneous thermal profile. This means that uneven thermal expansion and deformation in the turbine housing is mechanically imparted to the vane ring assembly (vane rings, mounting hardware and vanes) which causes rubbing between the moving vanes and the static vane rings ultimately causing sticking of the vanes. The inventors realized that by decoupling the vane ring assembly from being rigidly mounted to the turbine housing would remediate the sticking problem.

Figure 14:
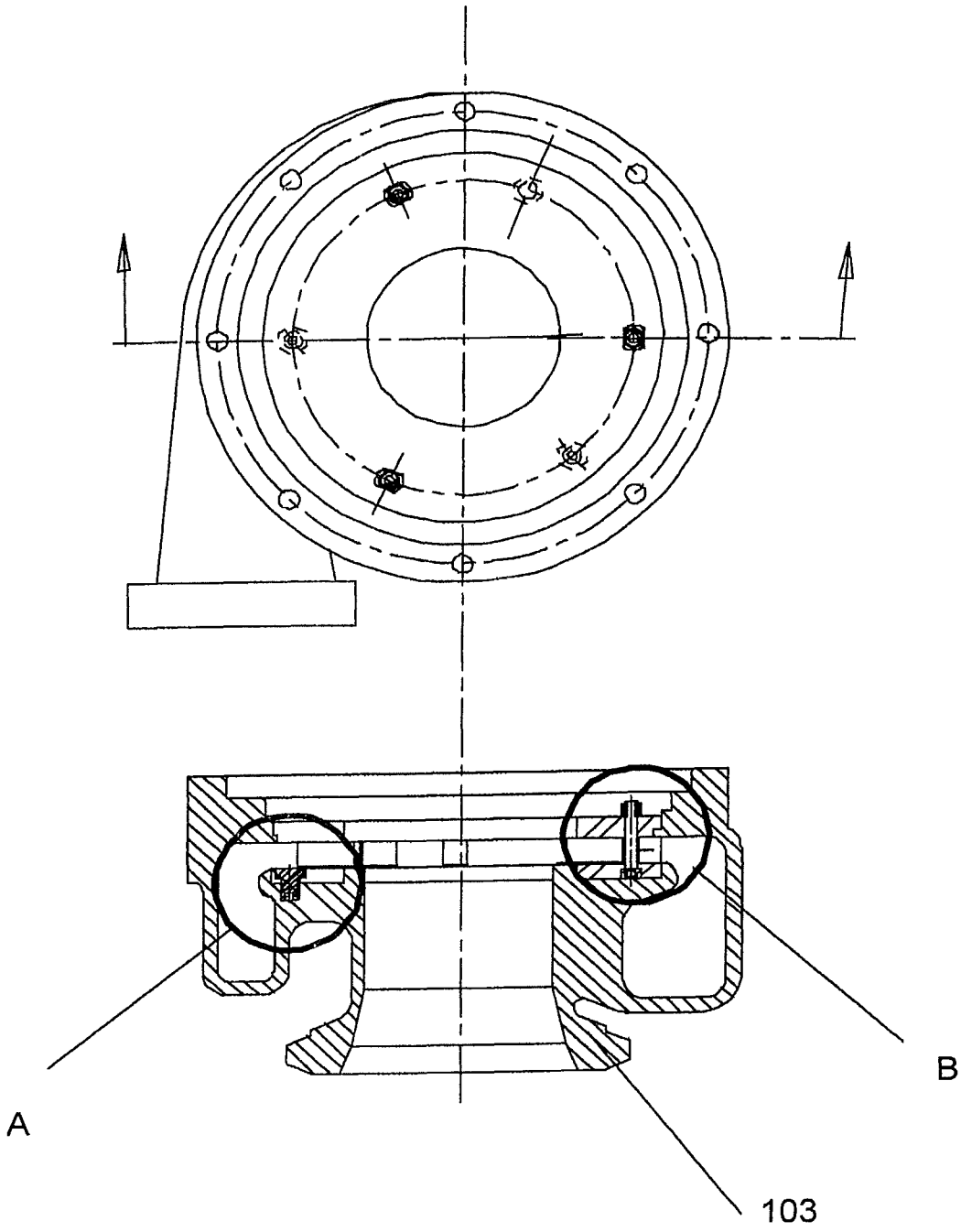
FIG. 14 is a plan and elevation view of the isolated vane ring assembly mounting scheme.
Figure 15:
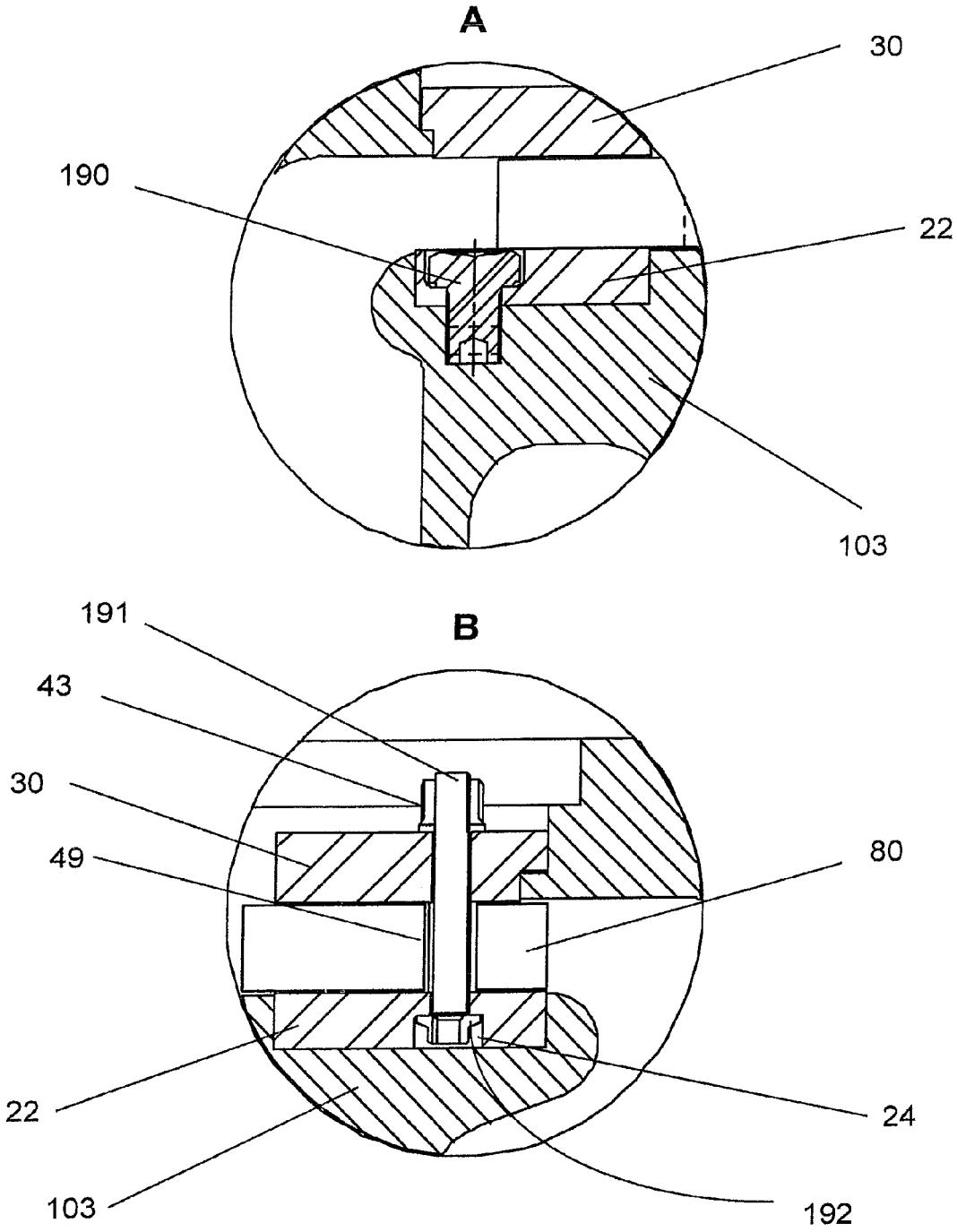
FIG. 15 is a set of magnified sections of the circles in FIG. 16, with a plain spacer.

In accordance with the present invention, as depicted in FIGS. 14 and 15, a first set of fasteners is used to fasten the lower vane ring to the turbine housing, and a second set of fasteners is used to fasten the lower vane ring to the upper vane ring. By not having the upper and lower vane rings fastened to the turbine housing by the same set of fasteners, the vane ring assembly is effectively decoupled from the turbine housing for purposes of thermal expansion, and the co-planerism of the vane rings is easier to maintain, eliminating the potential for vanes to stick due to relative movement through thermal growth, as is experienced when the lower and upper vane support rings are rigidly affixed to the turbine housing via studs, bolts, and the like. The invention thus provides an arrangement for connecting the vane ring assembly to the turbine housing that minimizes the adverse effect of thermal growth, or the effects of differential thermal growth, of the housing and/or vane ring assembly while maintaining efficiencies. The assemblies are cost effective, dependable, and are designed for ease of assembly.

In accordance with the invention a turbocharger is provided comprising a turbine housing (103), a vane ring assembly, comprising a lower vane ring (22), an upper vane ring (30), one or more guide vanes (80) pivotably mounted at least partially between said lower and upper vane rings, and at least one spacer (49) positioned between the lower and upper vane rings (20, 30) for maintaining a distance between the lower and upper vane rings (20, 30), one or more fasteners (190) fastening the lower vane ring (22) to said turbine housing (103) but not to the upper vane ring (30), and one or more fastener assemblies (191, 43) fastening the lower vane ring (20) to the upper vane ring (30) but not to the turbine housing (103).

In the illustrative embodiment above, the fastener (191) co-operates with the nut (43) to form a fastener assembly. The profiled head (192) of the fastener (191) is rotationally constrained by the indentation (24) in the bottom face of the lower vane ring.

Figure 1:
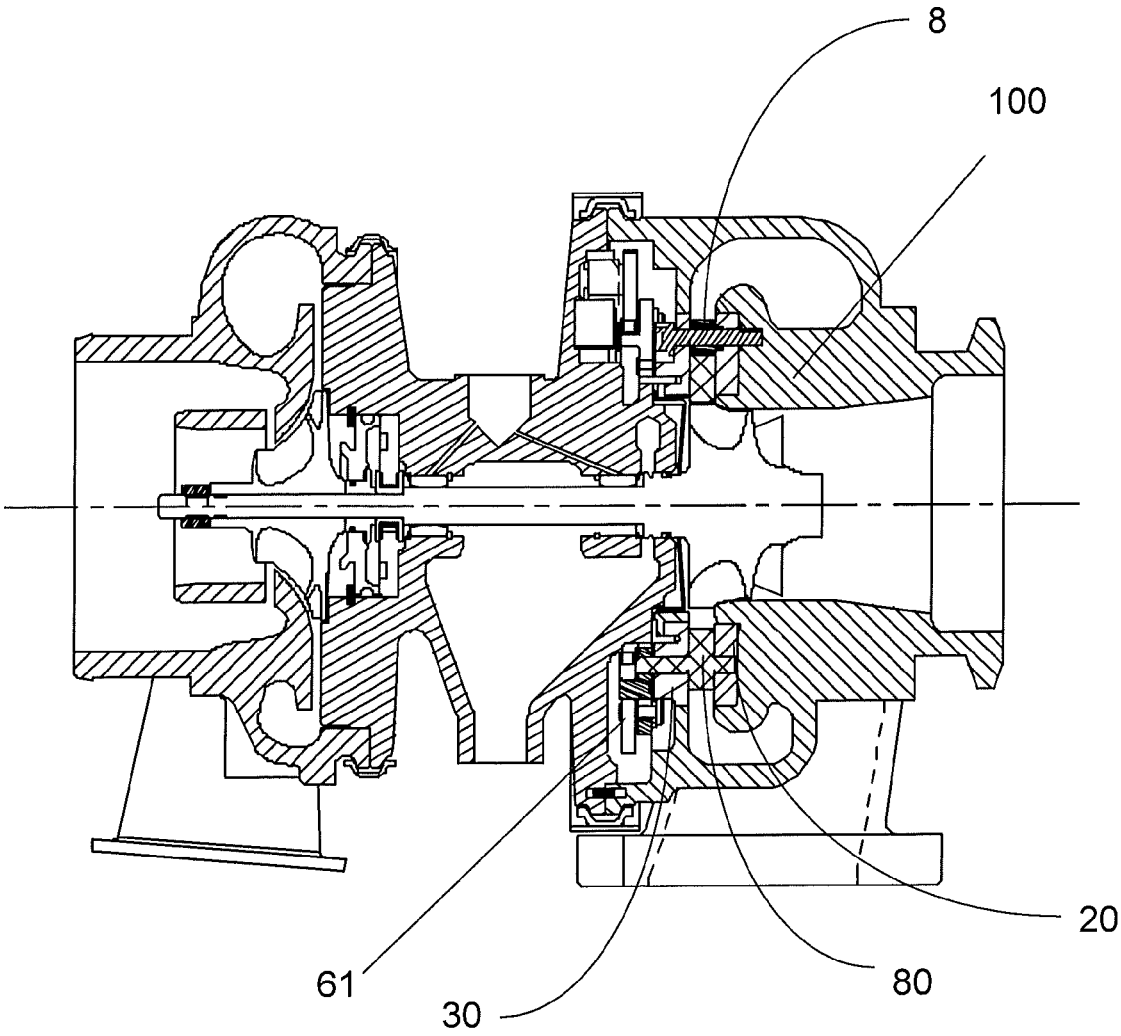
Fig. 1 Prior Art
FIG. 1 is a cross sectional view of a typical VTG turbocharger with both vane rings secured by bolts (8)
Figure 2:
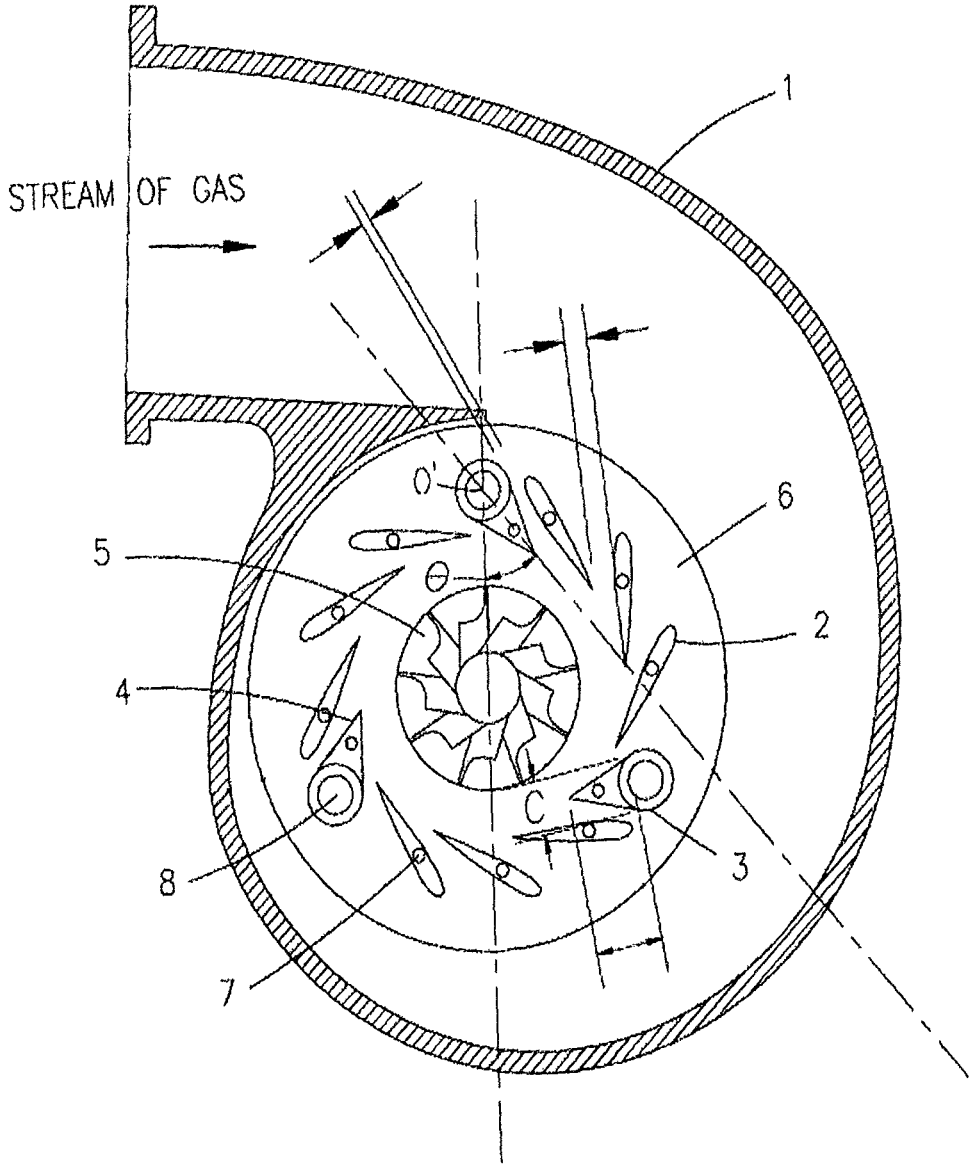
Fig. 2 Prior Art
FIG. 2 is a cross-sectional view of a turbine portion of a prior art turbocharger system according to U.S. Pat. No. 6,558,117.
Figure 3:
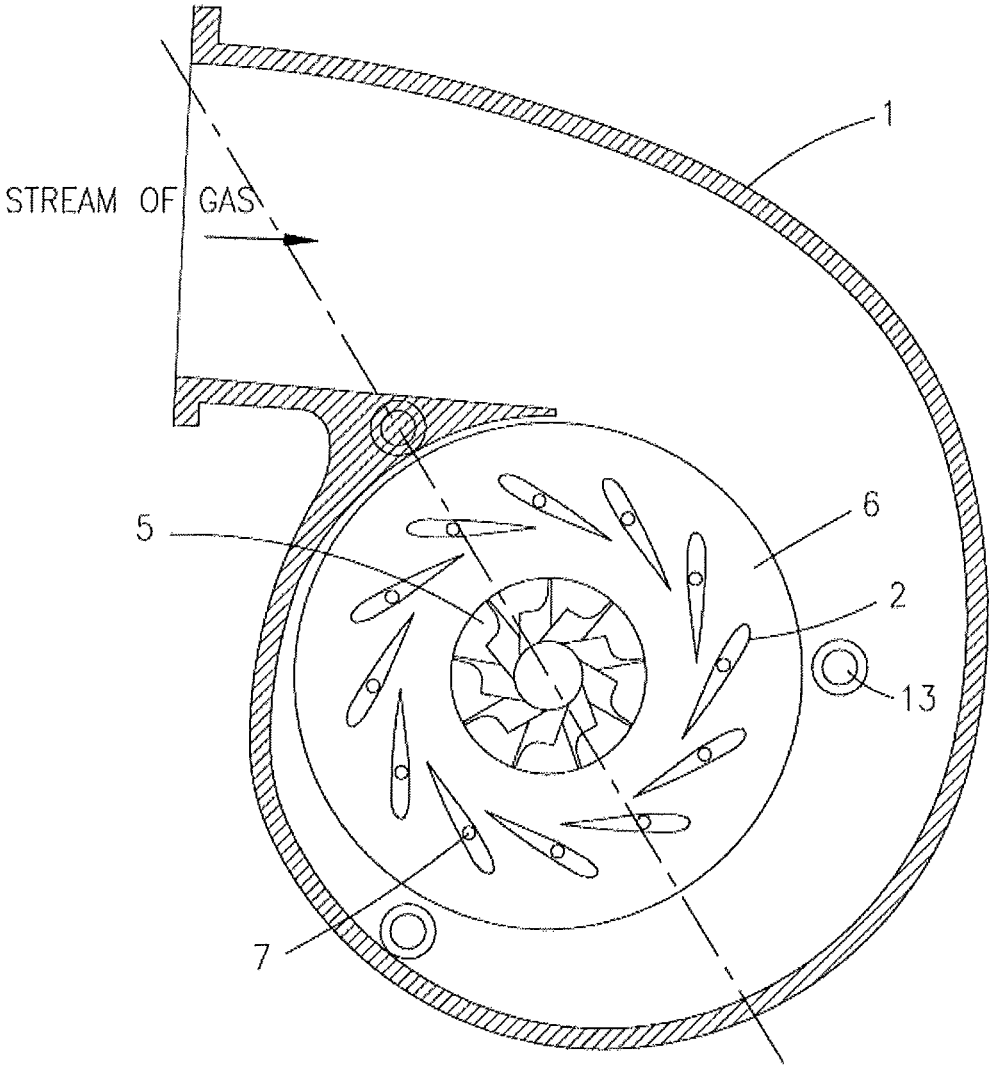
Fig. 3 Prior Art
FIG. 3 is a cross-sectional view of a turbine portion of another prior art turbocharger system according to U.S. Pat. No. 6,558,117.
Figure 4:
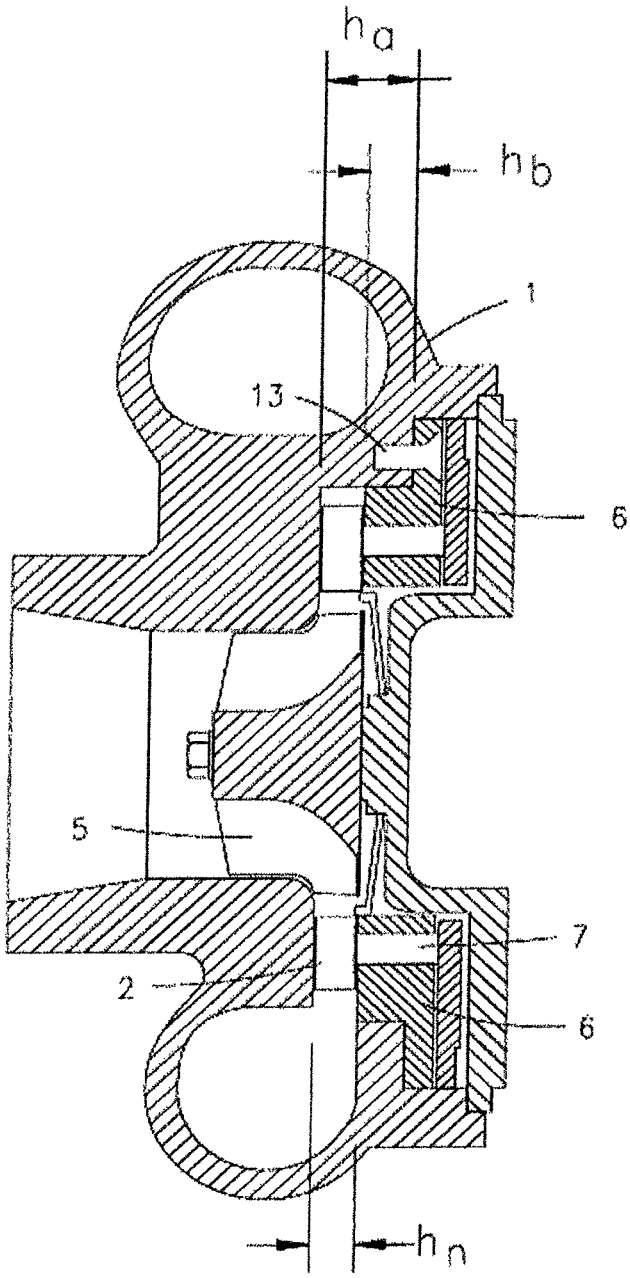
Fig. 4 Prior Art
FIG. 4 is an enlarged cross-sectional view of a portion of the prior art turbine portion of FIG. 3.
Figure 5:
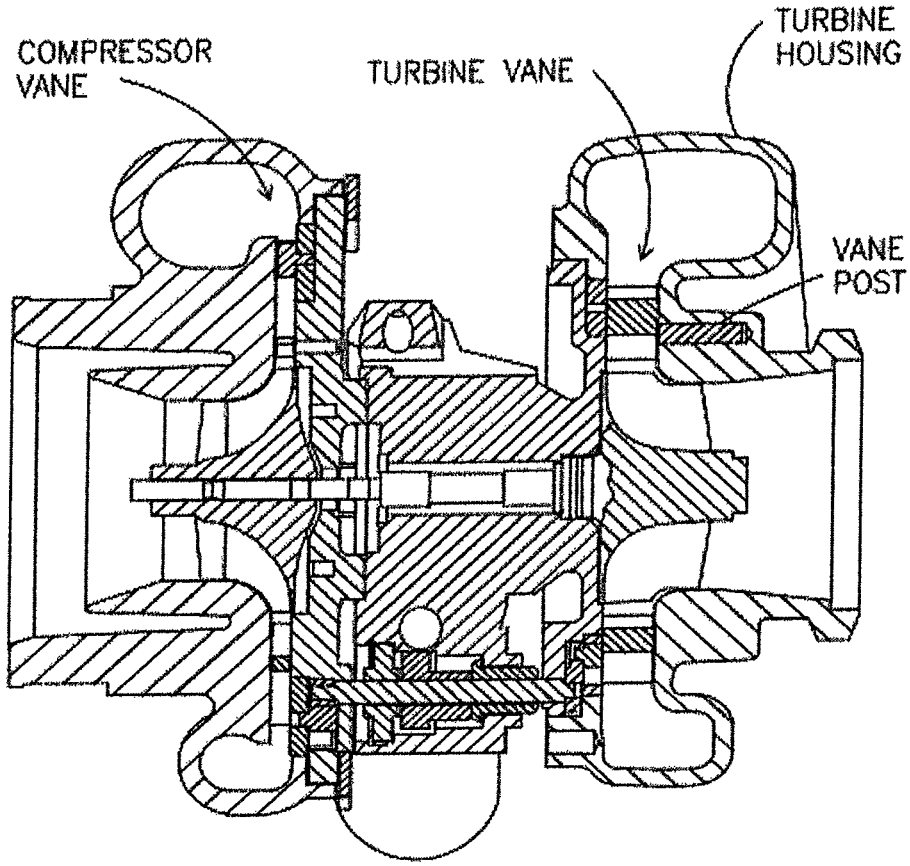
Fig. 5 Prior Art
FIG. 5 is a cross sectional view of another prior art turbocharger system according to U.S. Pat. No. 6,679,057 to Arnold, 2004.
Figure 6:
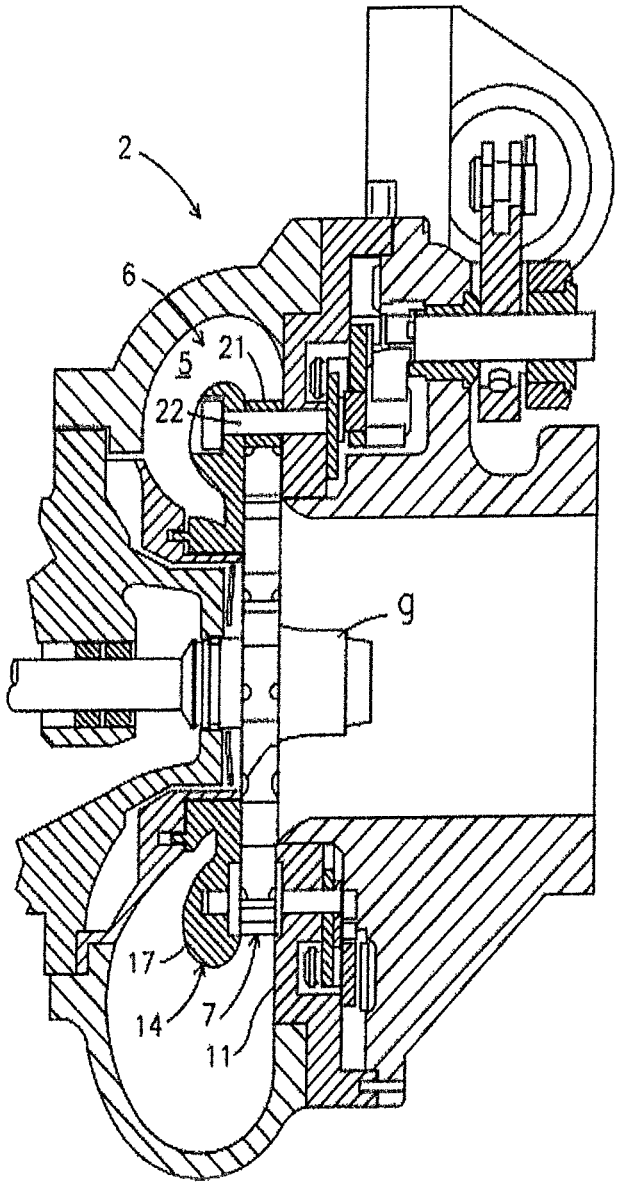
Fig. 6 Prior Art
FIG. 6 is a cross sectional view of another prior art turbocharger system according to U.S. Pat. No. 6,287,091 to Svihla.
Figure 7:
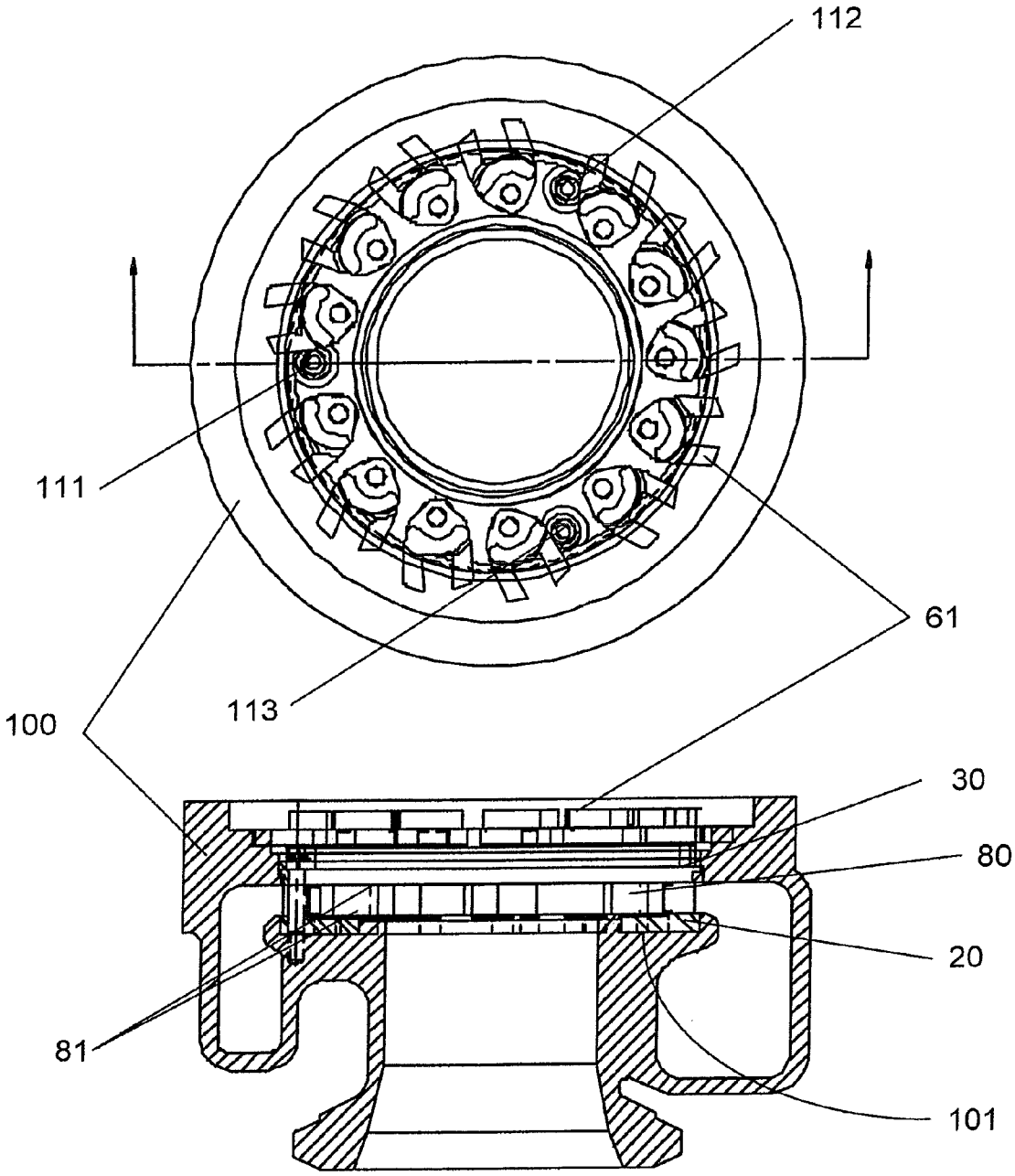
Fig. 7 Prior Art
FIG. 7 is a plan view, with its elevation of a prior art VTG assembly in a turbine housing. The view of the driving ring and fingers is omitted for clarity in subsequent views.

A turbocharger as shown in FIG. 1 has five major component groups: a compressor housing; a turbine housing; a center section incorporating the bearing system and providing support and location for the turbine housing and compressor housing; and the compressor and turbine wheels. Within the turbine housing assembly, depicted in FIG. 12, there exists, when arranged for assembly, the upper vane ring (30) supporting a plurality of VTG vanes (80) which are sandwiched between the upper vane ring and the lower vane ring (20) such that a spacer (49) locates the vanes rings in the axial relationship with each other with the distance between each vane ring set by the combination of, in the case of a stepped spacer, as shown in FIG. 13, the distance between the steps on the spacer (50) and the counterbores (52, 54) in each of the upper and lower vane rings (31, 23). In the case of a non-stepped spacer (49) the distance between vane rings is the distance between end-faces of the spacers and the faces of the lower and upper vane rings.

Figure 12:
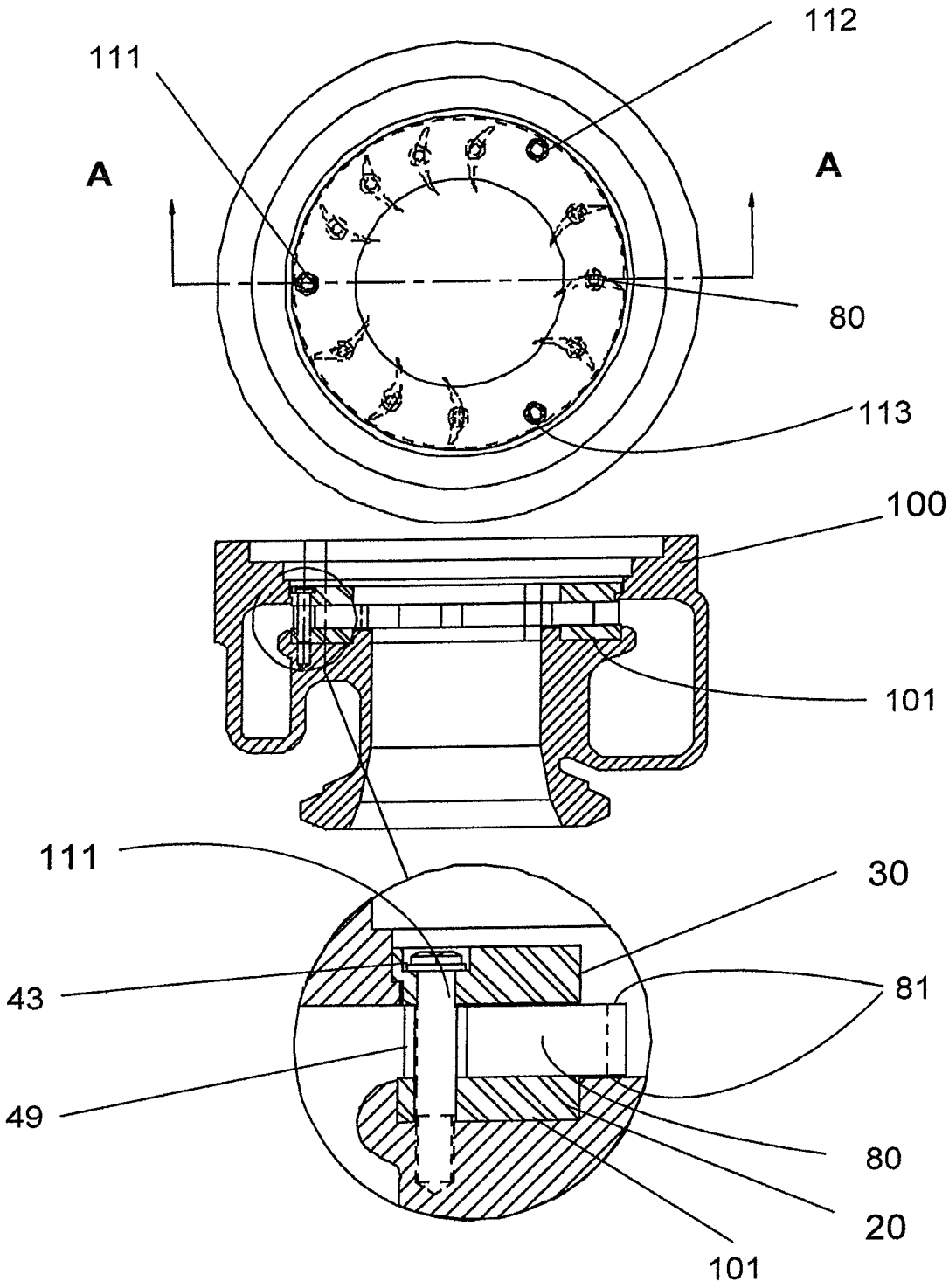
FIG. 12 is a plan and elevation of the turbine housing assembly, with a magnified section showing the assembly with a plain spacer.
Figure 13:
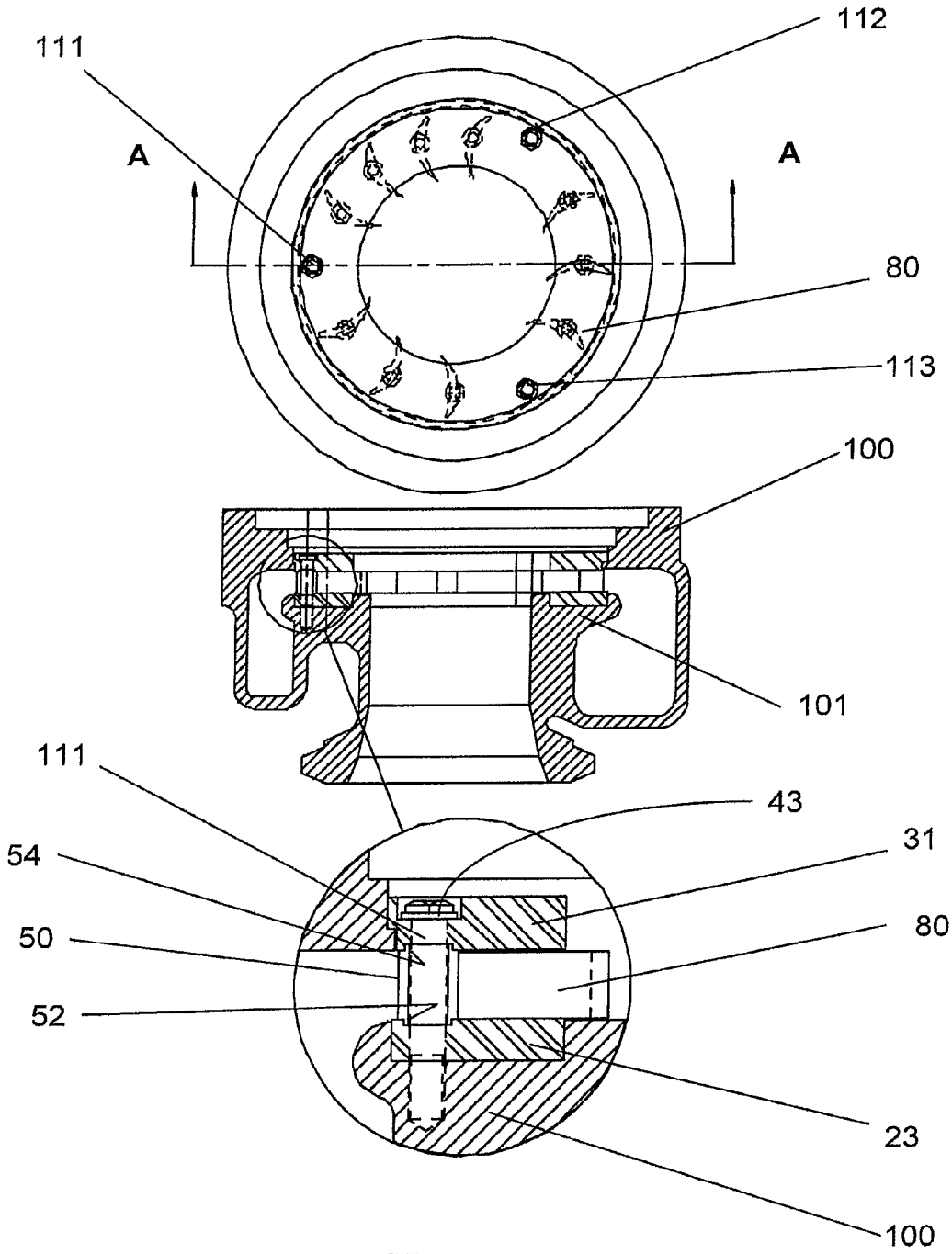
FIG. 13 is a plan and elevation of the turbine housing assembly, with a magnified section showing the assembly with a stepped spacer.

The spacing of the vane rings from each other, in conjunction with the width of the vanes (80), which is determined by the distance between the vane cheeks (see FIG. 12 (81)), is critical to the prevention of "blowby" and maintaining peak aerodynamic efficiency of the turbine stage of the turbocharger.

To control the width of the vane space, which is the distance of the lower vane ring from the upper vane ring, one or more spacers (49) or (50) can be positioned therebetween. The spacers (49) or (50) can be spaced around the circumference of the lower and upper vane support rings (20, 21, 22 or 23) and (30 or 31). In the exemplary embodiment, three spacers are used, but the present disclosure contemplates the use of other numbers of spacers. FIG. 12 displays the assembly with a plain, non-stepped spacer (49), FIG. 13 displays the assembly with a stepped spacer (50).

Figure 8:
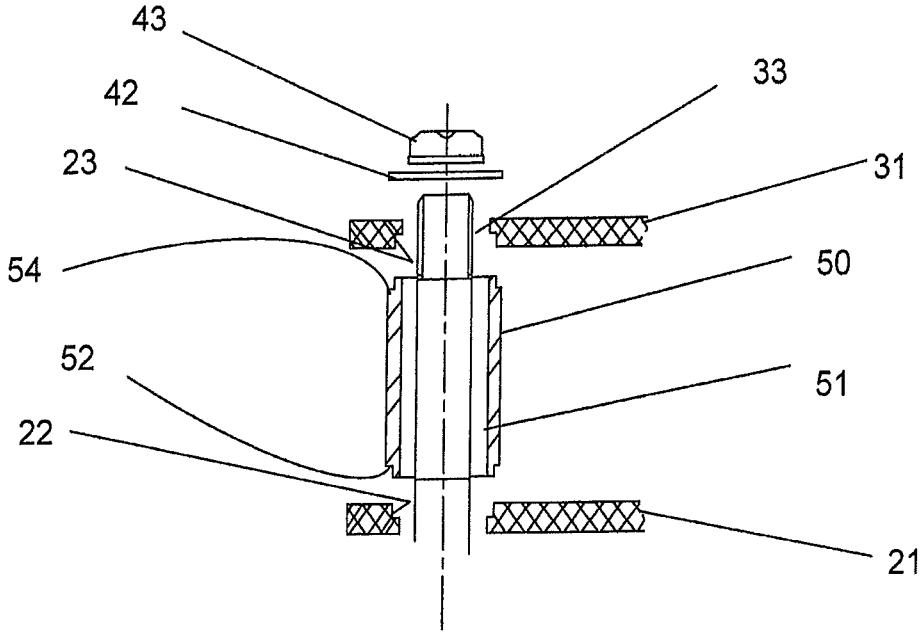
FIG. 8 is cross-sectional, magnified, exploded, view of a stepped spacer, stud and vane ring detail.
Figure 9:
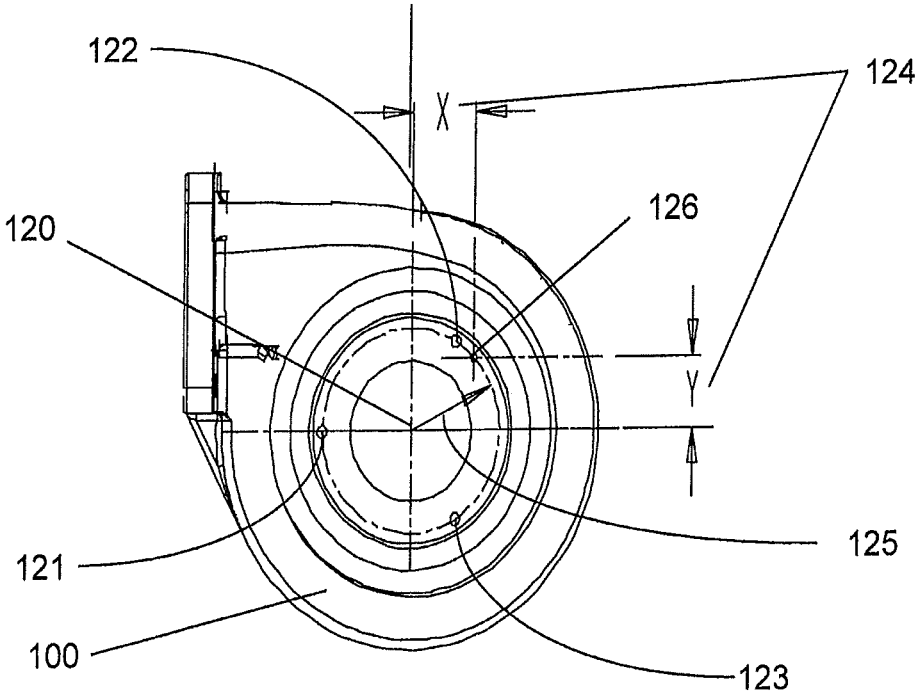
Fig. 9 Prior Art
FIG. 9 is plan view of the coordinates, which determine the position of the studs, in the turbine housing.
Figure 10:
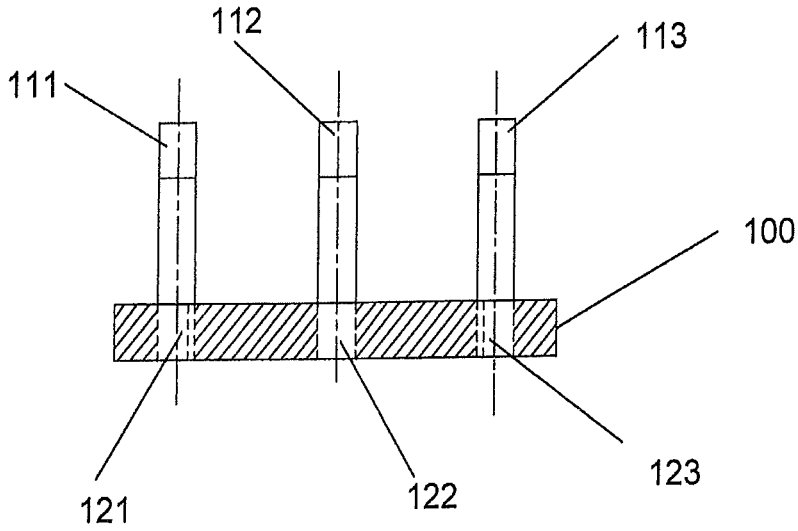
Fig. 10 Prior Art
FIG. 10 is a simplified cross sectional elevation, at ambient temperature.
Figure 11:
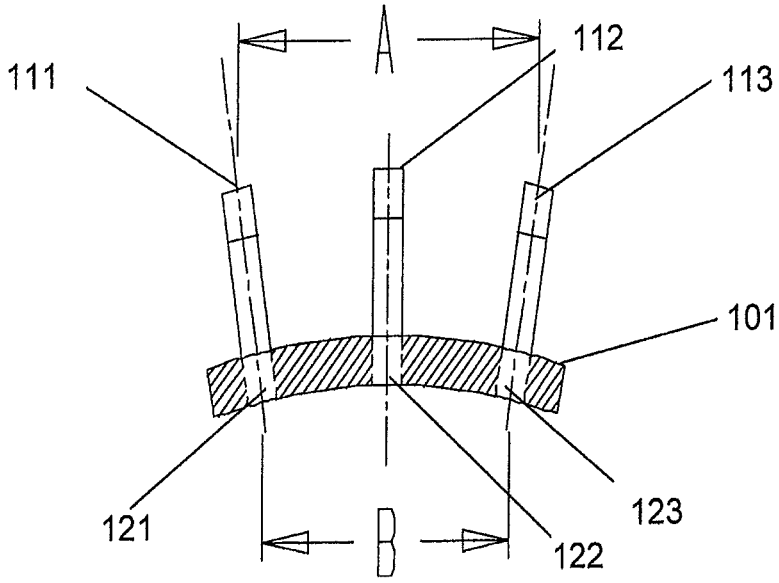
Fig. 11 Prior Art
FIG. 11 is the simplified cross sectional elevation of FIG. 10, subjected to a simplified case of thermal distortion.

The spacers (50) can be stepped, as seen in FIG. 8. The lower end of the spacer (50) has a stepped feature (52) having a shape adapted to being located in a corresponding mating feature (22) in the lower vane ring (21). The upper end of the spacer (50) has a stepped feature (54) which locates in a like mating feature (23) in the upper vane ring (31). The opposing ends are of reduced diameter as compared to the middle section of the spacer. The spacers (50) can be press-fit into their locations formed in the lower and upper vane rings. The spacers can be loose, or retained in some other fashion. What is important is that they establish the distance between the vane rings, and thus the side clearance to the vanes. The holes (33) can be through-holes or blind holes and any combination thereof. The particular size, shape, number, and configuration blind holes and any combination thereof. The particular size, shape, number, and configuration of spacers can be chosen based on a number of factors including ease of assembly, excitation of the turbine wheel, stiffness and thermal deformation control. The choice of material for the spacers can be based on several factors, including thermal coefficient of expansion, machinability, corrosion resistance, cost, strength and durability.

In the exemplary embodiment shown in FIG. 14, with magnified views in FIG. 15, for the fastening of the lower vane ring to the turbine housing as part of the novel fastening strategy for effectively decoupling the vane ring assembly from the turbine housing for purposes of thermal expansion, the lower vane ring (LVR) (22) is fixed to the turbine housing (103) using a precision fastener (190). The fastener could be, for example, a Dyna-Lock fastener. These fasteners are designed to minimize the clamp load on the item through which they mount, while taking advantage of a locking feature to prevent the fastener from backing out. Thus the LVR can be held in position, while being free to grow from thermal influences, without fear of the fastener coming loose.

Figure 16:
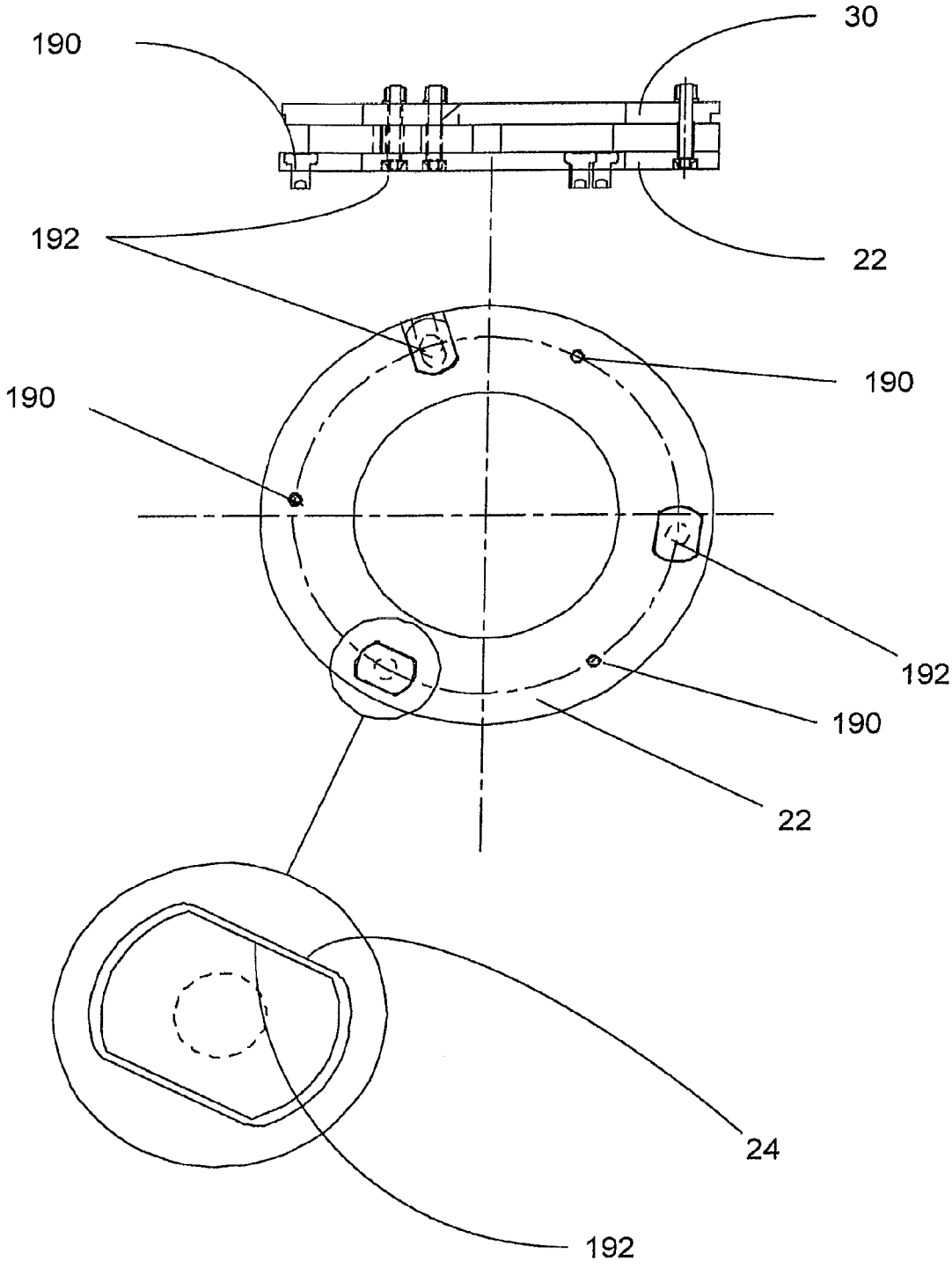
FIG. 16 is an elevation with a plan view of the underside of the LVR showing the slot and recess detail.

The holes, through which the above mentioned fasteners (190) pass, can be round. In one embodiment, as depicted in FIG. 16, these holes are a slotted shape, centered on radials to allow for radial thermal expansion. In another embodiment these holes are slotted, centered on radials and open to the periphery of the vane ring, to allow for radial thermal expansion and contraction.

The upper vane ring (UVR) (30) is affixed to the LVR (22) by means of a set of precision fasteners (191, 43) with profiled heads (192). These fasteners can be used to clamp a set of spacers (42) between the LVR (22) and the UVR (30). FIG. 16 shows a view under the LVR, of the profiled head (192) of the precision bolt. The profiled head locates in a like-profiled opening or recess (24) in the underside of the LVR (22). The purpose of the profiled holes is to prevent the bolt head from rotating, while the nut (43) is being tightened.

Figure 17:
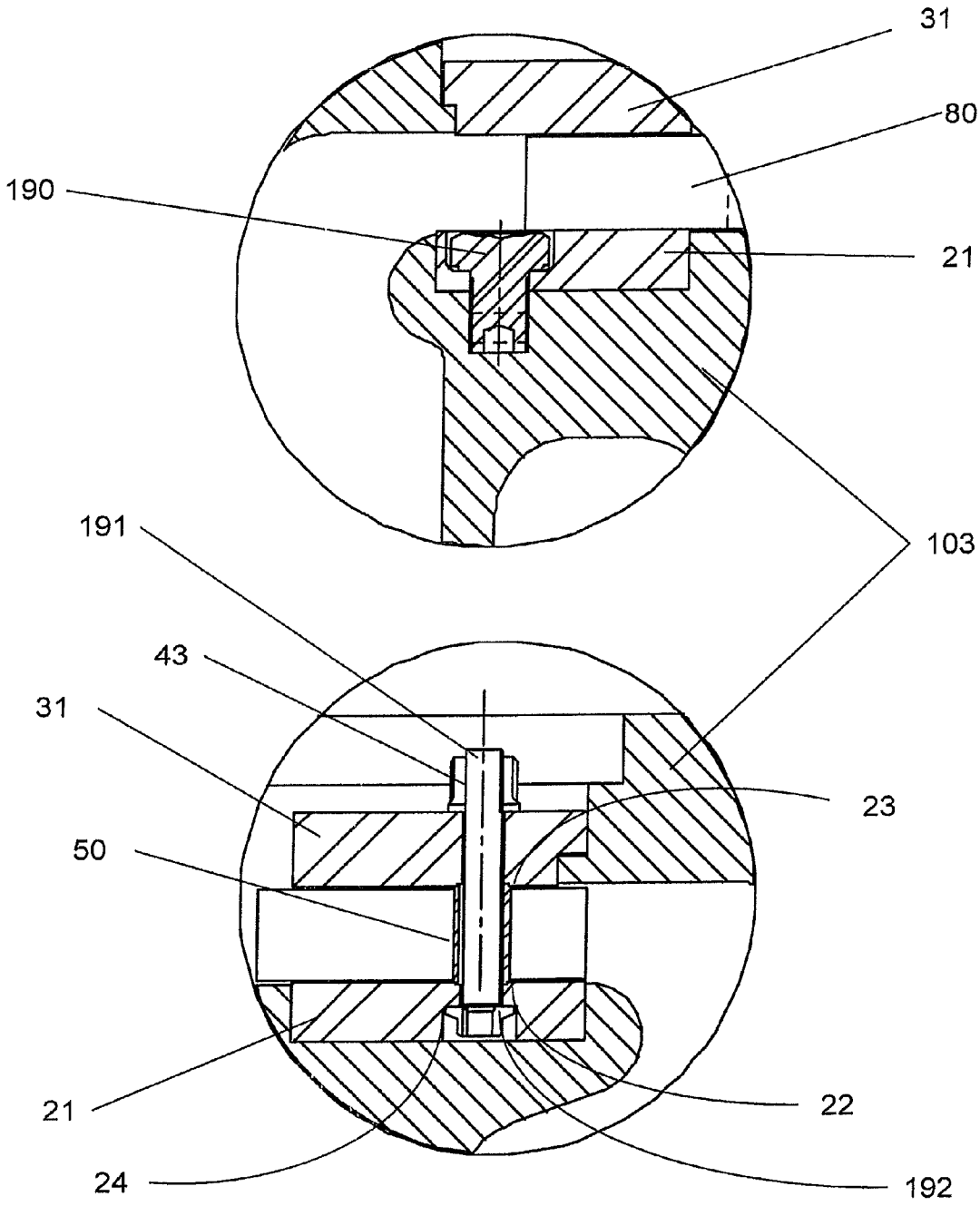
FIG. 17 is a set of magnified views of the sections, similar to those of FIG. 16, but with a stepped spacer.

If a stepped spacer (50) is used, then the UVR (31) and LVR (21) (see FIG. 17) enable the vane ring assembly to stay as an assembly without the bolts for ease of logistics and assembly. The profiled head (192) of the precision bolt locates in a like-profiled recess (24) in the underside of the LVR (21). The purpose of the profiled holes is to prevent the bolt head from rotating while the nut (43) is tightened. The bolt head thus positionally fixed to the LVR may also serve as anchor for the bolt, with the part of the bolt engaging the UVR being slidable, e.g., using a first step in the bolt as a spacer to set the distance between LVR and UVR, and a second step as a stop or abutment for the nut or for a washer so that the tightened nut does not apply clamping pressure on the UVR. Although as a general rule LVR and UVR are subject to similar thermal forces, in practice there are differences, and this "slide mounting" of the UVR allows for differential thermal expansion between UVR and LVR.

For changes in orientation of the vane ring (often driven by changes in orientation of the actuator) the holes in the turbine housing (103) may be re-oriented.

In the exemplary embodiment shown in FIG. 16 the recesses (24) are a slotted shape. The shape of these recesses (24) acts as a constraint against rotation of the profiled bolt head (192). The shape of the recess and the shape of the bolt head do not have to be slotted, but they preferably are a matched set, and they preferably resist rotation of the bolt head, in the recessed recess. The orientation or alignment of the slot, in this embodiment is immaterial. In FIG. 16 two slots are tangential, and one slot is on a radial to show this option. The radial slot is shown to be open at the periphery of the LVR, to show this option.

Figure 18:
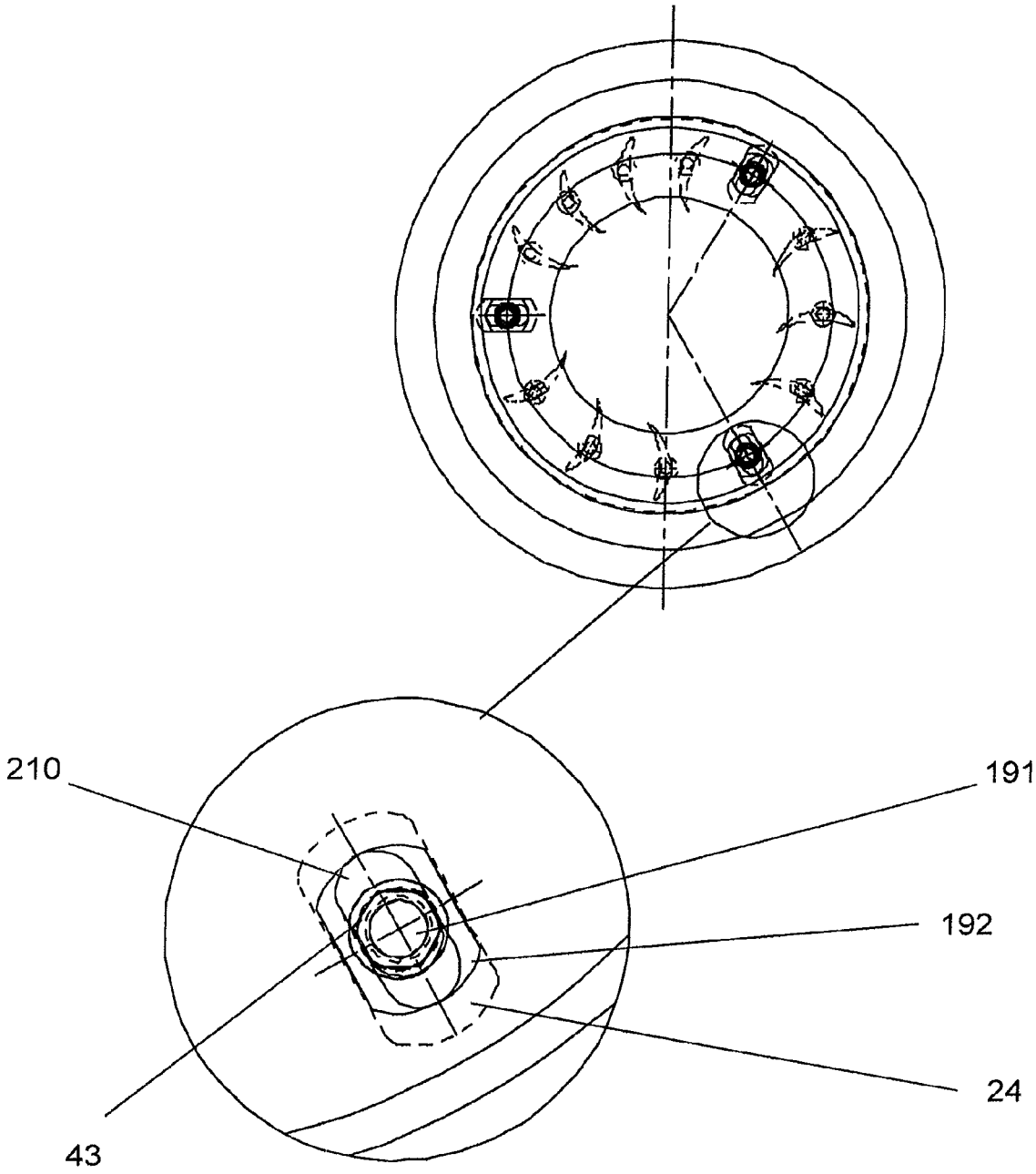
FIG. 18 is a plan view of a closed slot in the vane ring with a magnified view of the detail for clarity.

Another exemplary embodiment for the relationship between the spacers and the lower and upper vane rings is shown in FIG. 18. Through holes (210) with a recess in the form of a step (24) for the profiled fastener head (192), can be formed centered on radials near the periphery of each of the vane rings. Preferably, the holes (210) have a radially elongate or slotted shape so that each of the rings, or both rings in unison, with respect to the spacer, can undergo radial thermal expansion while maintaining the spacing between the rings. To allow for non-radial thermal expansion, which is known to be the case (the unconstrained turbine housing tries to become oval), the slot, with its mating step for the contoured fastener head, could assume a curved shape. In a preferred embodiment, the upper vane ring would have round, non-slotted holes, while the LVR has slotted holes.

Figure 19:
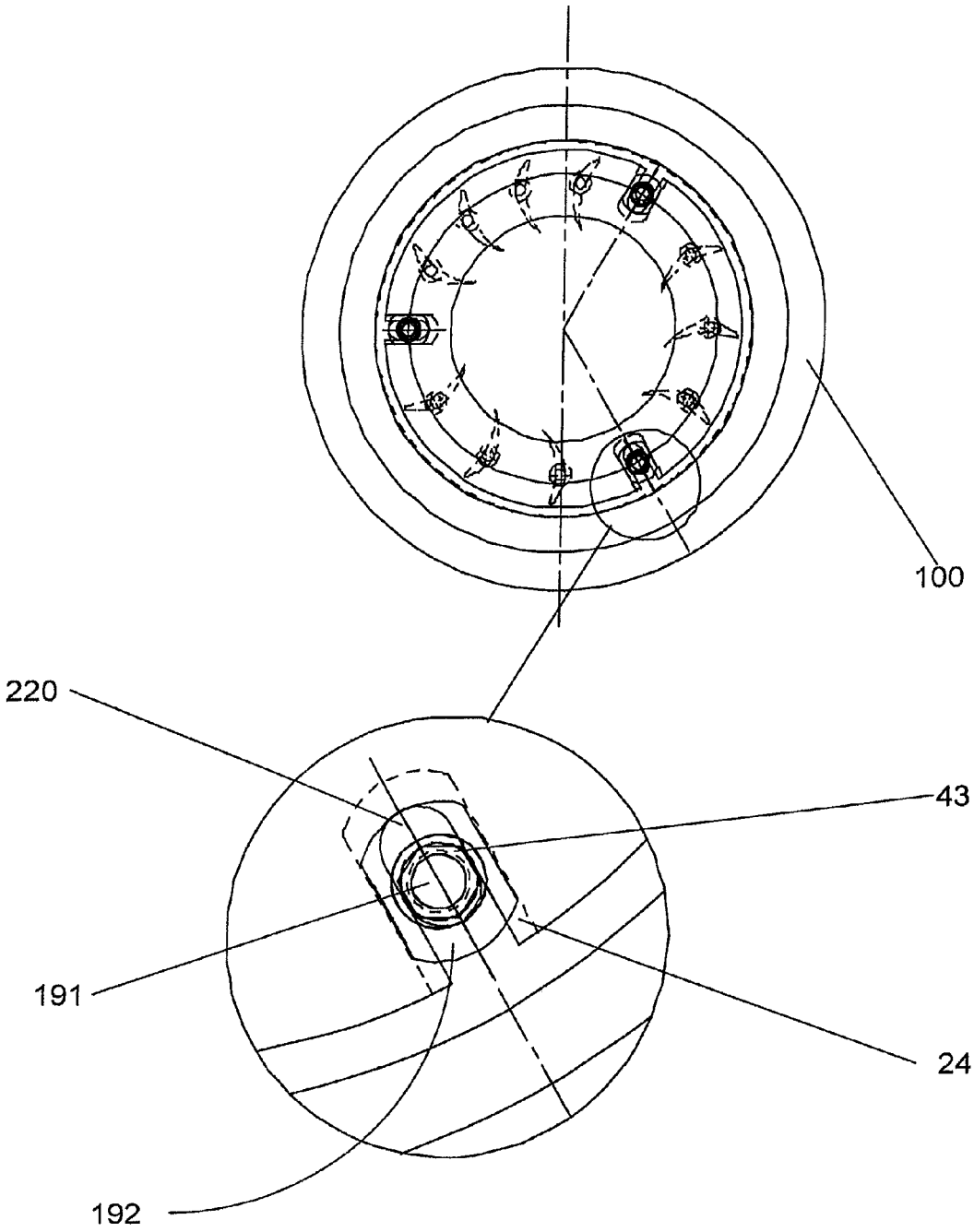
FIG. 19 is a plan view of the open slot in the vane ring, retained by a fastener, with a magnified view of the detail for clarity.
Figure 20:
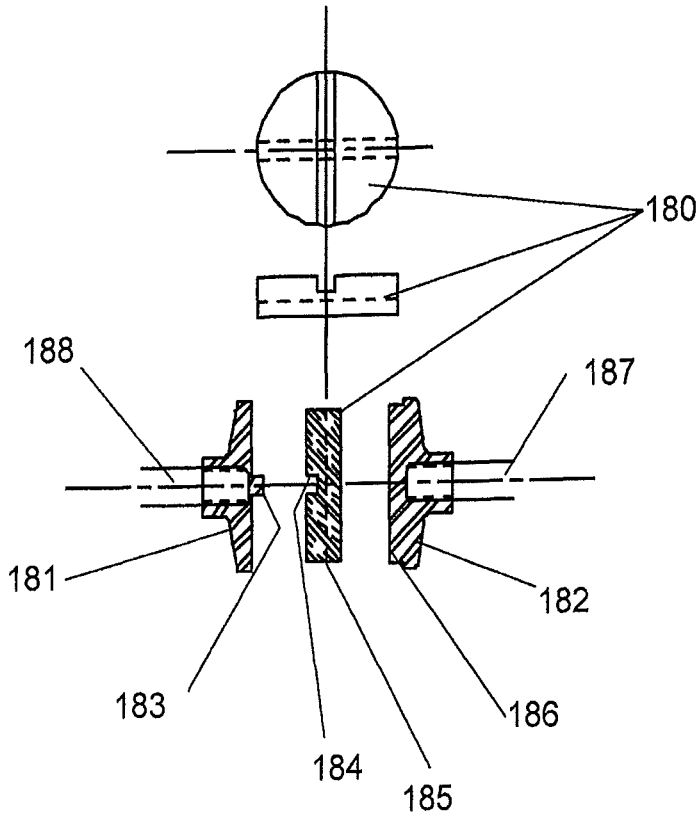
Fig. 20 Prior Art
FIG. 20 is a sketch of a coaxial cross key coupler in common use.

The LVR and UVR can have either both round or slotted holes, with slotted or fixed steps or recesses, for the profiled fastener head, with any combination thereof. Another exemplary embodiment for the connection between the spacers and the lower and upper vane rings is shown in FIG. 19. Elongate holes (220) with recess (24) for the profiled fastener head (192), can be formed, centered on radials, near the periphery of each of the support rings and can optionally be open along a circumference of each of the rings. Preferably, the holes (220) and recesses (24) have a slotted shape so that each of the rings, or both rings together, with respect to the spacer, can undergo radial thermal expansion while maintaining the spacing between the rings, with no deformation in the ring. To allow for non-radial thermal expansion, which is known to be the case (the unconstrained turbine housing tries to become oval) the slot, with its mating step for the contoured fastener head could assume a curved shape.

The LVR and UVR can have either round or slotted holes, with stepped locations for the profiled fastener, or any combination thereof.

Referring back to the spacers (42, 50), which are used to control the spacing of the vane rings, any number of spacers and fasteners can be used. In the exemplary embodiment three spacers (either 42 or 50) are spaced about the vane rings. In a preferred embodiment, the locating members (50) are fit into their locations formed in the vane rings and the assembly located in the turbine housing (103) with any number of locating fasteners.

The spacers (42) or (50) have a cylindrical shape, although the present disclosure contemplates the use of other shapes for the locating members, including the aerodynamic forms, which can be aligned with the direction of the gas flow to prevent flow separation around the spacer. The particular size, shape, number, and configuration of spacers (42) or (50) can be chosen based on a number of factors including ease of assembly, excitation of the turbine wheel, stiffness and thermal deformation control. The choice of material for the spacers (42) or (50) can be based on several factors, including thermal coefficient of expansion, machinability, corrosion resistance, cost, strength and durability.

The exemplary embodiments above have been described with respect to a vane ring assembly that adjusts vane position to control exhaust gas flow to the turbine rotor. However, it should be understood that the present disclosure contemplates providing a system or method of connection for a vane ring assembly that controls flow of a compressible fluid to the compressor rotor. The present disclosure further contemplates the use of the assembly system described herein for a turbocharger having both variable turbine geometry and variable compressor geometry. Such an arrangement for a variable compressor geometry can have many of the components described above for the variable turbine geometry, as well as other components known in the art.

While the invention has been described by reference to a specific embodiment chosen for purposes of illustration, it should be apparent that numerous modifications could be made thereto by those skilled in the art without departing from the spirit and scope of the invention.

Now that the invention has been described,

We claim:

1. A turbocharger comprising:

a turbine housing (100);

a vane ring assembly, comprising a lower vane ring (20, 21, 22, 23), an upper vane ring (30, 31), one or more guide vanes (80) pivotably mounted at least partially between said lower vane ring and said upper vane ring, and at least one spacer (50) positioned between said lower vane ring and said upper vane ring for maintaining a distance between said lower vane ring and said upper vane ring;

one or more fasteners (190) directly fastening said lower vane ring (20) to said turbine housing (100) but not to said upper vane ring (30), the one or more fasteners extending in a substantially axial direction of the vane ring assembly, and one or more fastener assemblies (191, 43) attaching said lower vane ring (20) to said upper vane ring (30) but not to said turbine housing (100).

2. The turbocharger as in claim 1, wherein said lower vane ring has radial elongate peripherally open slots through which the one or more fasteners (190) attaching said lower vane ring (20) to said turbine housing (100) extend, said radial elongate peripherally open slots allowing for thermal expansion of the lower vane ring (20, 21, 22, 23).

3. The turbocharger as in claim 1, wherein said at least one spacer (50) has a coaxial bore, and wherein said one or more fastener assemblies (191, 43) attaching said lower vane ring to said upper vane ring extend through said coaxial bore.

4. The turbocharger as in claim 1, wherein said one or more fastener assemblies attaching said lower vane ring (20) to said upper vane ring (30) extend through radially elongate or peripherally open through-holes in either said lower vane ring or said upper vane ring, the one or more fastener assemblies being connected to the vane ring in a non-sliding manner.

5. The turbocharger as in claim 1, wherein said one or more fasteners (190) extend through radial slots in said lower vane ring, and wherein said one or more fastener assemblies (191, 43) attaching said lower vane ring (20) to said upper vane ring (30) extend through radial slots in said upper vane ring.

6. The turbocharger as in claim 1, wherein said spacer is a stepped spacer with a spacer body section with a spacer outer diameter, and with first and second ends (52, 54) having outer diameters smaller than said spacer body section outer diameter, and wherein at least said first and second ends (52, 54) of said spacer (50) are seated in first and second counter bores formed in said lower and upper vane rings (20, 30).

7. The turbocharger as in claim 6, wherein at least one of said first counter bore and second counter bore are stepped, and wherein the associated stepped spacer end is matingly received in said stepped counter bore.

8. The turbocharger as in claim 1, wherein said spacer has a non-circular spacer cross-sectional profile and an axial bore.

9. The turbocharger as in claim 1, wherein said spacer has a non-circular spacer cross-sectional profile and is stepped such that the step determines the axial distance between upper vane ring and lower vane ring.

10. The turbocharger as in claim 1, wherein the one or more fastener assemblies attaching the lower vane ring to the upper vane ring extend through through-holes in at least one of the lower vane ring and the upper vane ring.

11. The turbocharger as in claim 1, wherein the one or more fasteners attaching the lower vane ring to the upper vane ring extend through through-holes in at least one of the lower vane ring and the upper vane ring.

12. The turbocharger as in claim 1, wherein the one or more fastener assemblies includes one or more nuts, each of the one or more nuts engaging a respective fastener attaching the lower vane ring to the upper vane ring, whereby said one or more fastener assemblies is formed.

13. A turbocharger comprising:

a turbine housing;

a vane ring assembly including a lower vane ring, an upper vane ring, one or more guide vanes pivotably mounted at least partially between the lower vane ring and the upper vane ring, and at least one spacer positioned between the lower vane ring and the upper vane ring for maintaining a distance between the lower vane ring and the upper vane ring;

one or more fasteners directly fastening the lower vane ring to the turbine housing but not to the upper vane ring, the one or more fasteners preventing the lower vane ring from moving relative to the turbine housing in a substantially axial direction of the vane ring assembly, and one or more fasteners attaching the lower vane ring to the upper vane ring but not to the turbine housing.

* * * * *